US007530473B2

(12) United States Patent
Chirnomas

(10) Patent No.: US 7,530,473 B2
(45) Date of Patent: May 12, 2009

(54) THERMAL SEPARATING DOOR IN A VENDING MACHINE

(76) Inventor: Munroe Chirnomas, 47 Skyline Dr., Morris Township, NJ (US) 07960

( * ) Notice: Subject to any disclaimer, the term of this patent is extended or adjusted under 35 U.S.C. 154(b) by 0 days.

(21) Appl. No.: 10/375,280

(22) Filed: Feb. 26, 2003

(65) Prior Publication Data

US 2003/0222094 A1 Dec. 4, 2003

Related U.S. Application Data

(60) Provisional application No. 60/360,129, filed on Feb. 26, 2002.

(51) Int. Cl.
*B65H 3/44* (2006.01)

(52) U.S. Cl. ..... 221/123; 221/90; 62/446

(58) Field of Classification Search ..... 221/123, 221/90, 99; 62/448
See application file for complete search history.

(56) References Cited

U.S. PATENT DOCUMENTS 1,969,401 A * 8/1934 Goodin ..... 221/236
2,104,034 A * 1/1938 Hamel ..... 62/266
2,321,642 A * 6/1943 Anthony ..... 221/126
2,376,561 A * 5/1945 Smith ..... 221/279
2,389,283 A * 11/1945 Stewart ..... 221/84
2,424,303 A * 7/1947 Carlson ..... 221/103
2,497,219 A * 2/1950 Haumann ..... 221/81
2,524,673 A * 10/1950 Martin ..... 53/168
2,541,787 A * 2/1951 Stewart ..... 312/97.1
2,561,828 A * 7/1951 Springsteen ..... 221/76
2,578,545 A * 12/1951 Haase et al. ..... 221/107
2,776,035 A * 1/1957 Hebel ..... 194/244
3,057,512 A * 10/1962 Shurtz ..... 221/77
3,493,956 A * 2/1970 Andrews et al. ..... 345/56
4,033,477 A * 7/1977 Hoppe et al. ..... 221/114
4,317,604 A * 3/1982 Krakauer ..... 312/97.1
4,391,388 A * 7/1983 Krakauer ..... 221/76
4,394,932 A * 7/1983 Ahlstrom ..... 221/83
4,398,651 A * 8/1983 Kumpfer ..... 221/6
4,677,278 A * 6/1987 Knoll ..... 219/214
4,730,750 A * 3/1988 Ficken ..... 221/124
4,812,629 A * 3/1989 O'Neil et al. ..... 235/383
5,097,986 A * 3/1992 Domberg et al. ..... 221/150 R (Continued)

FOREIGN PATENT DOCUMENTS

FR 2597239 10/1987

(Continued)

*Primary Examiner*—Patrick Mackey
*Assistant Examiner*—Michael E. Butler
(74) *Attorney, Agent, or Firm*—Lawrence C. Edelman

(57) ABSTRACT

A machine for vending articles, the machine including a housing, a storage area disposed within the housing and having a thermal barrier which separates the storage area from the remainder of the interior of the housing, a dispensing area having an access port disposed within the housing which allows a user of the machine to retrieve a dispensed article, a vertically oriented opening in the thermal barrier of the storage area, the opening dimensioned for allowing articles stored in the storage area to pass from the storage area to the dispensing area, and an article retrieval device nominally located in the storage area for moving articles from the storage area to the dispensing area via said opening. A door aligned with the opening is displaceable in response to movement of articles toward the opening by the article retrieval device.

28 Claims, 2 Drawing Sheets

U.S. PATENT DOCUMENTS 5,105,978 A * 4/1992 Trouteaud et al. ..... 221/150 R
5,210,387 A * 5/1993 Smith et al. ..... 221/150 HC
5,240,139 A * 8/1993 Chirnomas ..... 221/2
5,322,187 A * 6/1994 Zizola ..... 221/150 R
5,415,417 A * 5/1995 Reis, Jr. ..... 273/447
5,566,856 A * 10/1996 Fallen et al. ..... 221/150 HC
5,873,489 A * 2/1999 Ide et al. ..... 221/279
5,918,764 A * 7/1999 Bustos et al. ..... 221/211
5,957,326 A * 9/1999 Ostgaard ..... 221/211
5,975,348 A * 11/1999 Rudewicz et al. ..... 221/150 R
6,047,855 A * 4/2000 Lin ..... 221/150 HC
6,155,455 A * 12/2000 Yajima et al. ..... 221/97
6,170,285 B1 * 1/2001 Huffman et al. ..... 62/448
6,186,358 B1 * 2/2001 Peteraf ..... 221/85
6,253,955 B1 * 7/2001 Bower ..... 221/150 R
6,378,324 B1 * 4/2002 Percy et al. ..... 62/448
6,513,677 B1 * 2/2003 Sorensen et al. ..... 221/130
6,682,289 B1 * 1/2004 Credle, Jr. ..... 414/281

FOREIGN PATENT DOCUMENTS

WO WO 9207340 A1 * 4/1992

* cited by examiner

THERMAL SEPARATING DOOR IN A VENDING MACHINE

CROSS-REFERENCE TO RELATED APPLICATIONS

This application claims priority under 35USC 120 of U.S. Provisional Patent Application No. 60/360,129 filed Feb. 26, 2002, entitled "Thermal Separating Door In A Vending Machine". The entire disclosure of this patent application is incorporated herein by reference in its entirety.

SUMMARY OF THE INVENTION

The present invention provides a displaceable thermal separating door between a refrigerated compartment in a vending machine and a dispensing/customer pickup area.

BRIEF DESCRIPTION OF THE DRAWINGS

The accompanying drawings, which are incorporated herein and constitute part of this specification, illustrate preferred and alternative embodiments and details of the invention, and together with the general description given above and the detailed description given below, serve to explain various features of the invention.

DETAILED DESCRIPTION OF THE PREFERRED EMBODIMENT

Figure 1:
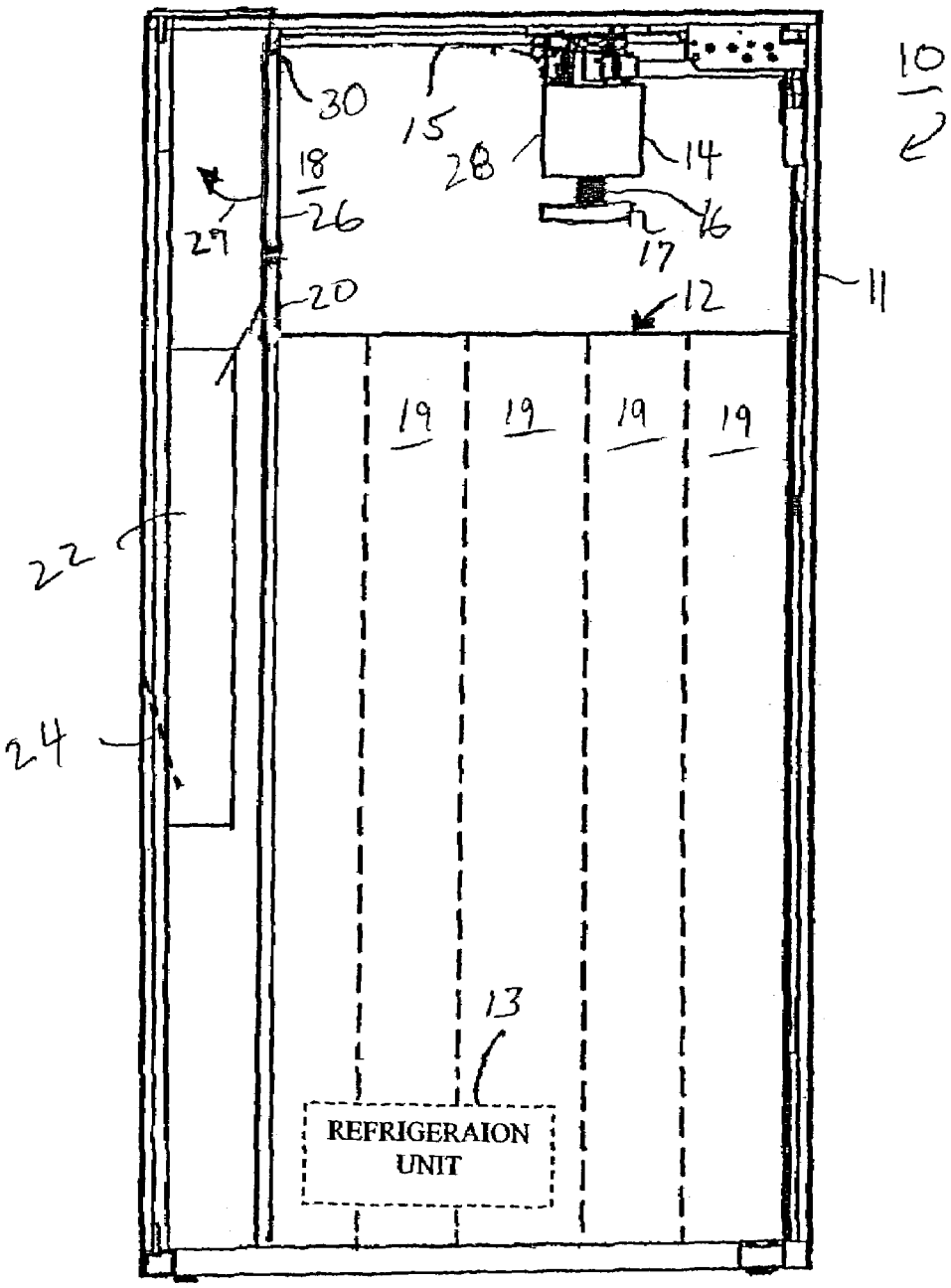
FIG. 1 is a side section view of a vending machine illustrating one embodiment of a thermal separating door constructed and operating in accordance with the principles of the present invention.

FIG. 1 illustrates a side section view of an article vending machine constructed and operating in accordance with the principles of the present invention. The vending machine generally includes a cabinet 11 upon which the conventional user interface components, such as a payment system, an article selection system and a display system are provided. Such conventional systems, being well known, are not shown or described further herein.

In accordance with the principles of the invention, the interior of cabinet 11 includes an article storage area 12, which can be cooled by a refrigeration unit 13 to approximately 35 to 50 degrees Fahrenheit for storing articles such as beverages, chocolate snacks or pastries, etc, or cooled to a greater degree, such as to minus 20 to minus 30 degrees Fahrenheit, for storing frozen articles, such as ice cream and/or other frozen foods. A robotic article retrieving device of known construction, such as described in my published PCT application WO 02/03340 (as well as, for example U.S. Ser. No. 10/205,770 entitled Method and Apparatus for Positioning an Article Handling Device, filed Jul. 25, 2002 and incorporated herein by reference), is illustrated herein by carriage 14. As described in detail in the forenoted applications, carriage 14 is positioned in the front/back and left/right directions using sliding supports and racks 15 and pinion gears, as well known to those ordinary skill in this technology, to position a suction pickup head 16 to various X and Y coordinate positions within the article storage area. Carriage 14 also includes a drive system, such as a set of pinch rollers, not specifically shown but described in detail in my forenoted applications, for positioning a suction hose which has the article pickup head 16 positioned at the free end thereof, in the vertical, Z, direction for retrieving articles 17 from vertically aligned stacks 19 of the articles stored in the storage area 12.

After the article pickup head 16, with suction supplied thereto, has been driven into and then out of a particular stack 19 within storage area 12 so as to retrieve an article 17, carriage 14 is driven towards an opening 18 in a side wall 20 of the cooled storage area 12. Opening 18 allows for movement of the selected articles 17 from inside of storage area 12 to a customer pickup area 22, where the user can reach the article 17 deposited therein via a swinging access door 24 of conventional design.

In accordance with one aspect of the invention a displaceable thermal separator in the form, in the illustrated embodiment of a vertically oriented thermally insulated door 26, is provided within opening 18, so as to prevent the escape of cold air and the egress of warm air into cooled storage area 12, at all times during normal operation of machine 10 except during the movement of articles by pickup head 16 from storage area 12 into the customer pickup area 22.

In the illustrated embodiment a leading edge portion 28 of carriage 14 can either directly or via an opening linkage (not shown) engage door 26 so as to displace it in the direction shown by the arrow 27, so that the that article pickup head 16 can be positioned over the customer pickup area 20 and the selected article can then be released, such release being caused, for example by the cessation of the suction force in pickup head 16. Alternatively, the pinch rollers in carriage 14 can drive the suction hose in the vertical direction so that the article can be gently deposited at the bottom of area 22 before being released.

In this embodiment of the invention, as well as in other embodiments described below, many variations are possible and in fact contemplated. For example, although door 26 is shown to be hinged above opening 18 using a hinge 30, in an alternative embodiment it may be desirable to have door 26 hinged from below opening 18. Similarly, it is possible the door 26 could be positioned over opening 18 using slides, so that door 26 would slide either perpendicular to or parallel with the wall in which opening 18 is formed.

Furthermore, it should be clearly understood that the present invention is independent of the type of article dispensing device used, and other types are contemplated, such as one using an articulated arm, expanding scissor or even a telescoping arm (moving in rectangular or even polar coordinates), as well as article grippers of alternative constructions, such as one using a mechanical claw or scoop, a magnetic attracting device, a portable suction generator, etc. Still furthermore, door 26 need not be thermally insulated in order that the benefits of the invention are still realizable. Even furthermore, instead of having a linkage or direct contact by carriage 14 which causes the opening of door 26, a separate motor could be used to open door 26. This motor could be activated by a position sensor which indicates that carriage 14 has reached a predetermined position, or by a microprocessor that controls the overall operation of machine 10.

Figure 2:
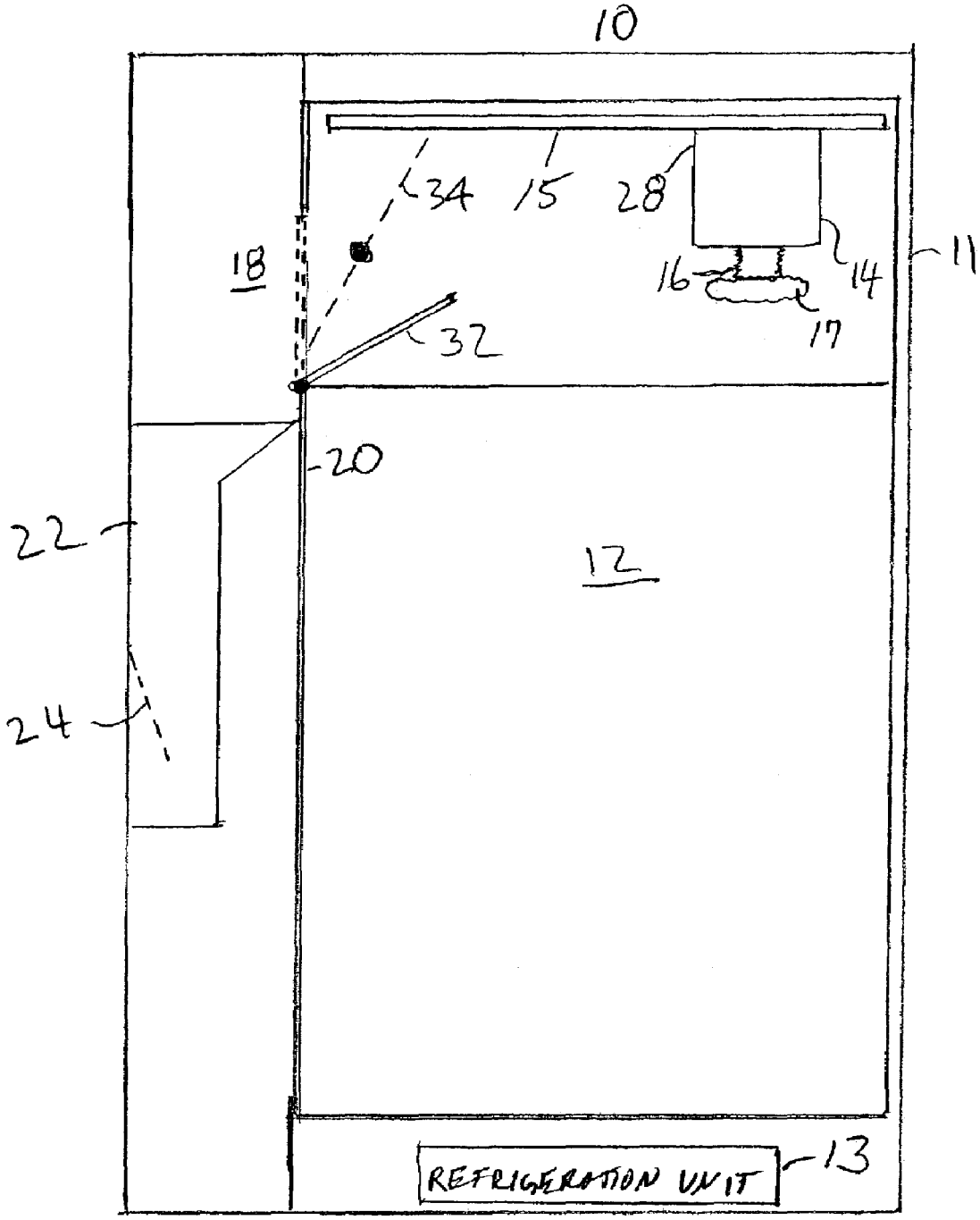
FIG. 2 is a side section view of a vending machine illustrating a further embodiment of a thermal separating door constructed and operating in accordance with the principles of the present invention.

FIG. 2 illustrates an embodiment in accordance with another aspect of the invention, where opening 18 includes a displaceable thermal separator in the form of a door 32. A pivoting linkage mechanism 34 has one end which engages door 32 and other end which is selectively engaged by, for example, the leading edge 28 of the robotic carriage 14, as carriage 14 is driven towards opening 18. Operation of linkage 34 causes door 32 to tilt into storage area 12. With a door and linkage mechanism constructed in accordance with this aspect of the invention, carriage 14 need not exit the storage area 12 to properly deliver the article to the customer pickup area 22, and instead article pickup head 16 can release an article 17 while it is still positioned within storage area 12, and that article will fall upon and slide along the upper side of door 32 so as to gradually move in a sliding manner from inside storage area 12 to a position where it will fall into the customer pickup area 22. Thus, door 32 may also act as an upper portion of the customer area 12. If the articles are of a delicate nature, the customer pickup area 22 could be positioned closer to opening 18, or a passive or active elevator type mechanism could be provided within customer pickup area 22 for gently lowering the articles therein. Alternatively, the suction hose can be used to gently lower the articles in area 22.

With this embodiment of the invention, carriage 14 never leaves the refrigerated environment, thereby minimizing the formation of condensation thereon which may happen each time door 32 is opened, allowing for the possibility that outside air having a humidity greater then the cooled air inside area 12 may enter into area 12. Formation of condensation on the mechanical and electromechanical parts inside of area 12 may undesirably effect these parts, thereby reducing their reliability and operability.

Furthermore, with the present invention, dispensing of the articles is completed with less movement of carriage 14 being required, thereby enabling a more rapid completion of the dispensing operation.

While the present invention has been disclosed with reference to certain embodiments, numerous modifications, alterations and changes to the described embodiments, for example, as noted above, are possible without departing from the sphere and scope of the present invention. Accordingly, it is intended that the present invention not be limited to the described embodiments, but that it has the full scope defined by the above language and the claims which follow, as well as equivalents thereof.

The invention claimed is:

1. A machine for dispensing articles from a storage area to a customer pickup receptacle, the machine comprising:

a housing having a space therein, at least one barrier structure positioned inside said housing which divides said space into at least two separate compartments, a first of said compartments being an article storage area for having said articles to be vended contained therein, said barrier structure comprising at least one of a vertical wall portion which encloses said article storage area, and a second of said compartments having said customer pickup receptacle contained therein, said customer pickup receptacle being accessible from outside said housing for enabling a customer of said machine to retrieve articles which have been dispensed;

an opening in the vertical wall portion of said barrier structure which encloses the article storage area, said opening being dimensioned for allowing articles stored in the storage area to pass from inside the storage area to outside of the storage area via said opening;

an article retrieval device nominally located in the article storage area for moving articles selected to be dispensed from inside the article storage area toward said opening; and a door having a pivot for selectively positioning said door into one of a first and a second position;

wherein:

when said door is pivoted so as to be in said first position, said door is aligned in a parallel manner with the opening in said barrier structure so as to cover the opening, when said door is pivoted so as to be in said second position, said door does not cover said opening and articles selected to be dispensed by said article retrieval device may pass through the opening during dispensing of articles from the article storage area, and wherein when said door is pivoted so as to be in said second position, said door is tilted into the storage area in a manner in which it blocks said article retrieving device from accessing at least some of the articles stored in the storage area, and said article retrieval device moves an article to be dispensed onto a surface of the door, which surface then facilitates movement of the said article towards the customer pickup receptacle.

2. The machine of claim 1, wherein said article retrieval device comprises a multi-axis robotic article positioning device.

3. The machine of claim 1, wherein said door is hinged to said barrier structure so as to pivot in said second position to an angled position so that said surface of the door forms a chute for moving said articles toward the customer pickup receptacle.

4. The machine of claim 1, wherein said door is hinged to said barrier structure so as to pivot in said second position to an angled position so that said surface of the door forms a slide for moving said articles toward the customer pickup receptacle.

5. The machine of claim 4, wherein said surface of the door moves said articles to a further angled surface which moves the articles further along towards the customer pickup receptacle.

6. The machine of claim 1, wherein when said door is pivoted so as to be in said second position, said surface of the door tilts into the inside of said article storage area.

7. The machine of claim 6, wherein when said door tilts into the inside of said article storage area, it is positioned over at least some of the articles still stored in the article storage area.

8. The machine of claim 1, further including a linkage mechanism operable to cause said door to move to said second position in response to mechanical contact on a portion of the linkage mechanism by a portion of the article retrieving device.

9. The machine of claim 1, wherein said article retrieving device moves in the article storage area in at least two axis in order to retrieve articles from the article storage area.

10. The machine of claim 1, wherein when said portion of said barrier structure which encloses the article storage area comprises a thermal barrier which thermally separates the article storage area from the remainder of said space inside the housing.

11. A machine for dispensing articles, the machine comprising:

a housing;

a storage area disposed within the housing, said storage area having generally horizontally oriented base and top barrier portions and generally vertically oriented barrier sidewall portions, which base, top and sidewall portions physically isolate the storage area inside of the housing;

a dispensing area having an access port disposed within the housing;

a generally vertically oriented portion of the barrier sidewall portion of the storage area having an opening formed therethrough, said opening being dimensioned for allowing articles stored in the storage area to pass through said barrier sidewall portion as they are dispensed from the storage area; and an article retrieval device nominally located in the storage area for moving articles from the storage area to a point which leads to the dispensing area via said opening;

a door aligned with the opening so as to form a barrier over said opening, and a linkage mechanism coupled to the door, said linkage mechanism operating to cause the door to open in response to mechanical contact on a portion of the linkage mechanism by a portion of the article retrieving device, and wherein when said door is open, said door is tilted, and when so tilted, a side of the door facing the article retrieving device is adapted to serve as a slide for moving articles positioned thereon by the article retrieving device through said opening and toward the dispensing area, said door being tilted into the storage area in a manner in which it blocks said article retrieving device from accessing at least some of the articles stored in the storage area.

12. The machine of claim 11, wherein said article retrieval device comprises a multi-axis robotic article positioning device.

13. The machine of claim 12, wherein said multi-axis robotic article positioning device includes a pickup head coupled to a multi-axis positioning mechanism, said pickup head selectively grasping and securing to a selected article to be dispensed.

14. A machine for vending articles, the machine comprising:

a housing;

a storage area disposed within the housing and having a barrier which separates the storage area from the remainder of the interior of the housing;

a dispensing area having an access port disposed within the housing;

a vertically oriented opening in the barrier of the storage area, dimensioned for allowing articles stored in the storage area to pass from the storage area toward the dispensing area; and an article retrieval device nominally located in the storage area for moving articles from the storage area toward the dispensing area via said opening, further including, a door aligned with the opening, and a linkage mechanism coupled to the door, said linkage mechanism operating to cause the door to open, wherein when said door is open, said door is tilted so that one side of the door serves as a slide for moving articles, positioned thereon by the article retrieving device, through said opening and toward the dispensing area, said door being tilted into the storage area in a manner in which it blocks said article retrieving device from accessing at least some of the articles stored in the storage area.

15. The machine of claim 14, wherein said barrier of the storage area comprises a thermal barrier which thermally separates the storage area from the remainder of said space inside the housing.

16. The machine of claim 11, wherein said barrier of the storage area comprises a thermal barrier which thermally separates the storage area from the remainder of said space inside the housing.

17. The machine of claim 14, wherein when said door is tilted into the storage area, it is positioned so as to block said article retrieving device from accessing at least some of the articles stored in the storage area.

18. The machine of claim 11, wherein when said door is tilted into the storage area, it is positioned so as to block said article retrieving device from accessing at least some of the articles stored in the storage area.

19. The machine of claim 14, wherein said article retrieval device comprises a multi-axis robotic article positioning device.

20. The machine of claim 19, wherein said multi-axis robotic article positioning device includes a pickup head coupled to a multi-axis positioning mechanism, said pickup head selectively grasping and securing to a selected article to be dispensed.

21. A machine for dispensing articles, the machine comprising:

a housing;

a storage area for storing inside the storage area articles to be vended, said storage area being disposed within the housing, said storage area having generally horizontally oriented base and top barrier portions and generally vertically oriented barrier sidewall portions, which base, top and sidewall portions physically isolate the storage area inside of the housing from the remainder of the inside of the housing;

a dispensing area having an access port, which said dispensing area is located within said remainder of the inside of the housing;

a generally vertically oriented portion of the barrier sidewall portion of the storage area having an opening formed therethrough, said opening being dimensioned for allowing articles stored in the storage area to pass from said storage area through said barrier sidewall portion as they are dispensed from the storage area and into the dispensing area; and an article retrieval device nominally located in the storage area for moving articles from the storage area to a point which leads to the dispensing area via said opening;

a door aligned in a parallel manner with the opening so as to form a barrier over said opening, and a linkage mechanism coupled to the door, said linkage mechanism operating to cause the door to open in response to mechanical contact on a portion of the linkage mechanism by a portion of the article retrieving device, and wherein when said door is open, said door is tilted, and when so tilted, a side of the door facing the article retrieving device is adapted to serve as a slide for moving articles positioned thereon by the article retrieving device through said opening and toward the dispensing area, said door being tilted into the storage area in a manner in which it's position blocks said article retrieving device from accessing at least some of the articles stored in the storage area.

22. The machine of claim 21, wherein said barrier of the storage area comprises a thermal barrier which thermally separates the storage area from the remainder of said space inside the housing.

23. The machine of claim 21, wherein said article retrieval device comprises a multi-axis robotic article positioning device.

24. The machine of claim 23, wherein said multi-axis robotic article positioning device includes a pickup head coupled to a multi-axis positioning mechanism, said pickup head selectively grasping and securing to a selected article to be dispensed.

25. A machine for vending articles, the machine comprising:

a housing;

a storage area for storing inside the storage area articles to be vended, said storage area being disposed within the housing and said storage area having a barrier portion which separates the inside of the storage area from the remainder of the interior of the housing;

a dispensing area having an access port disposed within the housing;

a vertically oriented opening in the barrier of the storage area, dimensioned for allowing articles stored in the storage area to pass from the storage area toward the dispensing area; and an article retrieval device nominally located in the storage area for moving articles from the storage area toward the dispensing area via said opening, further including, a door aligned in a parallel manner with the opening, and a linkage mechanism coupled to the door, said linkage mechanism operating to cause the door to open, wherein when said door is open, said door is tilted so that one side of the door serves as a slide for moving articles, positioned thereon by the article retrieving device, through said opening and toward the dispensing area, said door being tilted into the storage area in a manner in which it's position blocks said article retrieving device from accessing at least some of the articles stored in the storage area.

26. The machine of claim 25, wherein said barrier of the storage area comprises a thermal barrier which thermally separates the storage area from the remainder of said space inside the housing.

27. The machine of claim 25, wherein said article retrieval device comprises a multi-axis robotic article positioning device.

28. The machine of claim 27, wherein said multi-axis robotic article positioning device includes a pickup head coupled to a multi-axis positioning mechanism, said pickup head selectively grasping and securing to a selected article to be dispensed.

* * * * *